United States Patent [19]

Mattei

[11] Patent Number: 4,600,021

[45] Date of Patent: Jul. 15, 1986

[54] METHOD FOR SEPARATING TOBACCO PARTICLES ON CIGARETTE MANUFACTURING MACHINES

[75] Inventor: Riccardo Mattei, Bologna, Italy

[73] Assignee: G. D. Societa' per Azioni, Bologna, Italy

[21] Appl. No.: 616,154

[22] Filed: Jun. 1, 1984

[30] Foreign Application Priority Data

Jun. 14, 1983 [IT] Italy ..... 3461 A/83

[51] Int. Cl.[4] ..... A24C 5/39

[52] U.S. Cl. ..... 131/110; 131/109.2

[58] Field of Search ..... 131/109 B, 110, 84 R, 131/84 B, 84 C, 108, 109 R, 109 AB; 209/639, 644

[56] References Cited

U.S. PATENT DOCUMENTS

| | | | |
|---|---|---|---|
| 3,665,932 | 5/1972 | Goldbach | 131/110 |
| 3,727,755 | 4/1973 | Cristiani | 131/110 |
| 3,871,385 | 3/1975 | David | 131/110 |
| 4,024,878 | 5/1977 | Labbe | 131/84 B |
| 4,463,768 | 8/1984 | Quarella | 131/110 |
| 4,526,182 | 7/1985 | Labbe | 131/109.1 |

FOREIGN PATENT DOCUMENTS 2096876 10/1982 United Kingdom .

*Primary Examiner*—V. Millin
*Assistant Examiner*—H. Macey
*Attorney, Agent, or Firm*—Marshall, O'Toole, Gerstein, Murray & Bicknell

[57] ABSTRACT

Method for separating tobacco particles on cigarette manufacturing machines, whereby particles of shredded, carded tobacco are fed, through a side inlet passage, into a chamber communicating at the top with an upward feed channel, at the bottom with a downward reject channel, on one side with an inlet passage and on the other side with a by-pass channel, one outlet of which communicates with a mid point on the reject channel. The particles reaching the by-pass channel are first slowed down inside the channel, then isolated from the chamber, brought up to room pressure and finally dropped, at essentially zero initial speed, along an outlet portion of the by-pass channel and through at least one air current moving upward in the direction of the reject channel.

9 Claims, 1 Drawing Figure

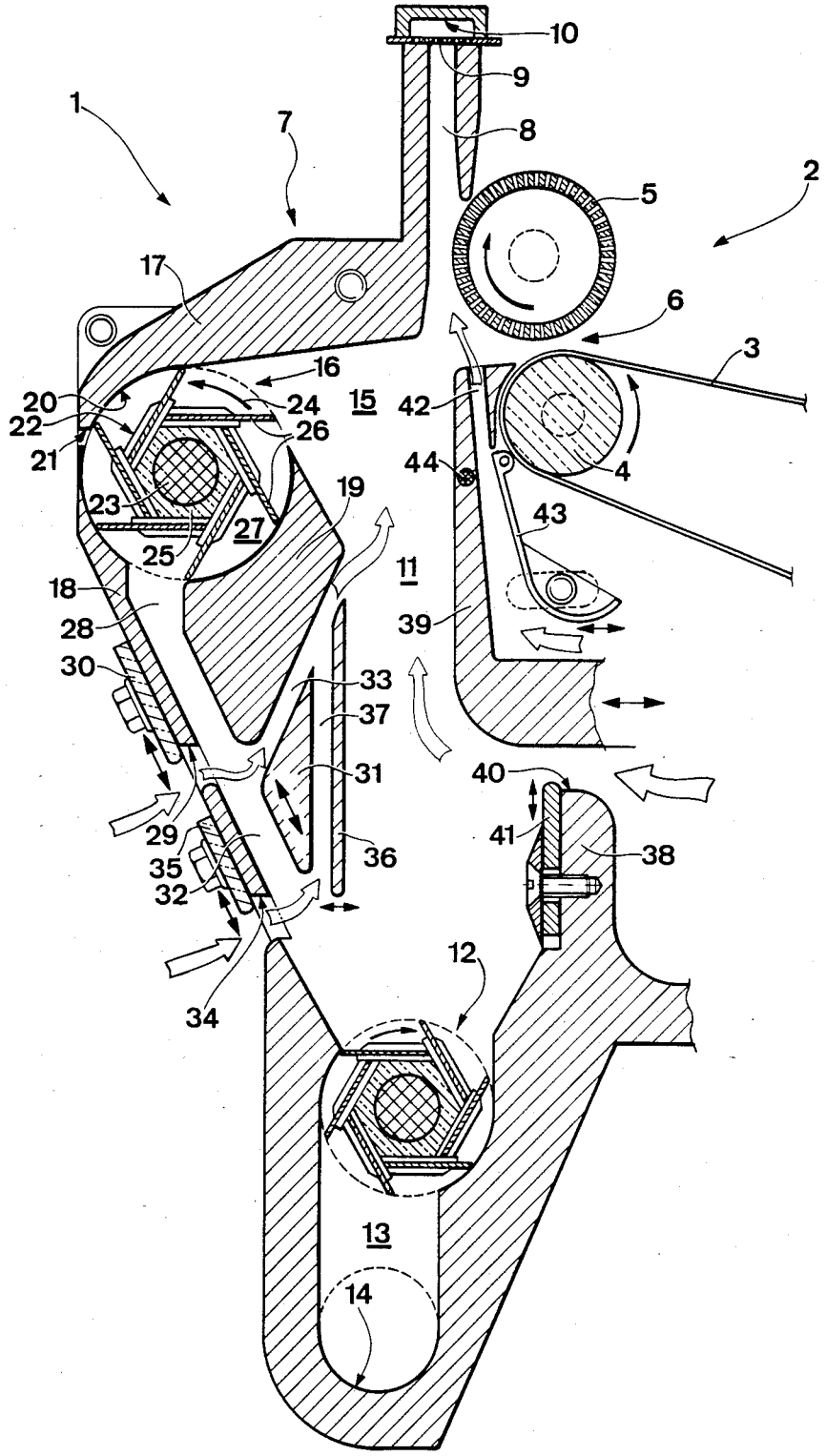
10
9
8
1
7
2
5
6
3
17
16
15
42
20
22
21
24
26
44
4
23
19
43
27
25
11
18
28
39
30
33
37
31
40
29
41
38
35
36
32
12
34
13
14

METHOD FOR SEPARATING TOBACCO PARTICLES ON CIGARETTE MANUFACTURING MACHINES

BACKGROUND OF THE INVENTION

The present invention relates to a method for separating tobacco particles on cigarette manufacturing machines. On cigarette manufacturing machines, the shredded tobacco particles are normally drop-fed from a feedbox on to a carding device and, from the latter, on to an essentially horizontal conveyor belt.

The latter, in turn, feeds the tobacco particles to a separating unit the function of which is to separate the lightweight tobacco particles, from which the cigarettes are made, from the heavier, woody ones consisting of the ribs from the processed tobacco leaves. The heavier particles are normally dropped into a reject collecting channel, whereas the lightweight particles are suction fed into a vertical channel closed off at the top by a suction conveyor belt.

On known types of separating devices, the method used for separating the lightweight particles from the heavier ones usually consists in setting up the output end of the said conveyor inside a chamber communicating, on one side, with the said vertical channel and, on the other, with the said reject channel, the latter channels usually being aligned with each other and having an air current blowing upwards through them. Thus, the lightweight particles are swept upwards along the said vertical channel, whereas the heavier particles drop down, against the current, along the reject channel.

For many types of tobacco, however, the abovementioned separating method has failed to keep the lightweight particle reject percentage within an acceptable margin. And not surprisingly since, on reaching the separating unit, the lightweight and woody particles are still closely bound together with the result that a considerable amount of lightweight particles is rejected together with the woody ones.

A known method of attempting to overcome this drawback consists in separating the heavier particles again as they fall down the reject channel, such separation usually being performed by hurling the heavier particles against the air current flowing up the reject channel. The abovementioned separating method is particularly effective when used on the separating device covered in British Pat. No. 2.096.876 on which the route travelled along by the heavy particles coming off the said conveyor is fitted with a baffle device for feeding the heavy particles into the reject channel against the air current with essentially no charge in kinetic energy. The impact between the high-speed heavy particles moving downwards and the air current blowing upwards produces a violent swirl inside the reject channel which separates the lighter tobacco strands from the woody particles.

Though more efficient than other known types of separating devices, the aforementioned known device still fails to separate all the woody particles from the lighter ones, a certain amount of which still manages to get rejected.

This drawback would appear to be caused by the excessive kinetic energy the heavier particles are possessed of when fed against the air current into the reject channel. In fact, on account of the speed they are travelling at, the woody particles always manage to carry some of the lighter particles clinging to them off to the reject channel.

SUMMARY OF THE INVENTION

The aim of the present invention is to provide a separating method for minimising the amount of lightweight particles rejected.

With this aim in view, the present invention relates to a method for separating tobacco particles on cigarette manufacturing machines, characterised by the fact that it comprises stages consisting in:

- generating a main air current moving upwards along a reject and a supply channel, both channels being essentially vertical and essentially aligned with each other;
- feeding shredded, carded tobacco particles at relatively high speed across the said main air current towards the inlet of a by-pass channel extending between a top and mid point on the said reject channel;
- slowing down the particles reaching the said by-pass channel and isolating, in watertight manner, the said particles from the said main current;
- raising the pressure of the said isolated particles;
- dropping the said isolated particles, at essentially zero initial speed, into the said reject channel, along a route travelled by at least one upward-moving secondary current flowing into the said main current.

BRIEF DESCRIPTION OF THE DRAWING

The present invention will now be described with reference to the attached drawing showing, by way of a nonlimiting example, a cross section of a separating device according to the present invention.

DETAILED DESCRIPTION OF THE INVENTION

Number 1 on the attached drawing indicates a cigarette manufacturing machine comprising a tobacco supply unit (2) the output element on which consists of a conveyor belt (3) arranged essentially horizontally and comprising an output pulley (4) arranged facing and underneath a suction roller (5). Roller 5 and conveyor 3 combine to define an inlet passage (6) through which supply unit 2 communicates with separating device 7, in turn, communicating with an essentially vertical upward feed channel (8). The latter is closed off at the top end by a conveyor belt (9) through which air can be blown and which separates channel 8 from chamber 10 communicating with suction means (not shown) for creating a depression inside chamber 10 and channel 8.

Separating device 7 comprises an essentially vertical downward reject channel (11) aligned with channel 8 and sealed off watertight at its lower end by a rotary conveyor element (12) between channel 11 and drop 13 communicating with reject collecting channel 14. At its top end, channel 11 comes out into chamber 15 which communicates, at the top, with the bottom end of channel 8, at the bottom, with channel 11, on one side, with passage 6 and, on the other, with by-pass channel 16 extending between chamber 15 and the mid point of channel 11.

Channel 16 is defined, at the top, by an outer wall (17) on separating device 7, on one side, by a second outer wall (18) on device 7 and, on the other, by a separating body (19) between channels 11 and 16.

An upper input portion of channel 16 consists of a cylindrical chamber (20) having its axis perpendicular to that of channel 11 and communicating, on one side, with chamber 15 and, on the other, with the outside via hole 21 in wall 18.

Chamber 20 houses conveying means comprising a rotary conveying element (22) fitted on to shaft 23 extending through chamber 20 in an essentially horizontal direction and activated by activating means (not shown) so as to turn at variable speed in the direction shown by arrow 24. Rotary conveyor element 22 comprises a centre body (25) from which extend outwards a number of blades (26) evenly spaced round centre body 25 and engaging in watertight manner with the side surface of chamber 20 so as to define a number of conveying pockets (27). As conveyor element 22 turns, the said pockets (27) communicate selectively and in succession with chamber 15 and an output portion (28) of channel 16 extending downwards from the bottom of chamber 20.

Just beneath the bottom end of body 19, output portion 28 of channel 16 communicates with the outside via hole 29 in wall 18, the section of which may be regulated by means of a valve element (30).

In an alternative arrangement not shown, portion 28 of channel 16 terminates on a level with hole 29 and comes out directly inside a mid portion of channel 11. In the arrangement shown, on the other hand, provision is made under body 19 for a second separating body (31) which combines with wall 18 to define a bottom portion or extension (32) towards the bottom of portion 28 of channel 16 and, with body 19, to define an upward channel (33). The latter is arranged with its bottom end essentially facing hole 29 and extends upwards in a direction essentially aligned with that of the axis on channel 8 so as to come out inside the bottom of chamber 15.

The section of channel 33 may be altered by adjusting separating body 31 in relation to body 19.

Close to conveyor element 12 and, in any case, beneath the bottom end of body 31, wall 18 is provided with a further hole (34) the aperture of which may be regulated by means of valve element 35.

According to the arrangement shown, provision is made to the side of body 31 for an essentially vertical dividing wall (36) which, on other arrangements (not shown) may be dispensed with.

Together with body 31, wall 36 defines an essentially vertical upward channel (37) the bottom end of which is arranged on a level with hole 34 and the top end of which communicates with a point on channel 33.

The position of the said wall (36) may be regulated vertically or horizontally via regulating means not shown. On the side opposite wall 18, channel 11 is bordered laterally by a fixed bottom wall (38) and movable top wall (39) which combine to define an opening (40) the aperture of which may be regulated by means of valve element 41.

Through movable wall 39, provision is made for an air supply duct (42) essentially aligned with channel 8 and the section of which may be regulated by means of movable plate 43. The top end of duct 42 communicates with passage 6 at a point which may be positioned by moving wall 39. According to the arrangement shown, movable wall 39 is fitted so as to rock round an intermediate pin (44) parallel with shaft 23, whereas, in alternative arrangements (not shown), it may move crosswise and even rock as well if needed.

During operation, suction through chamber 10 forces air through duct 42, holes 29 and 34 and opening 40 through one or more of which compressed air may be blown, if necessary, inside device 7. The tobacco particles fed by conveyor 3 into chamber 15 through passage 6 intersect the air stream blowing up towards channel 8 from channel 11 and duct 42. The impact between the said air stream and the stream of tobacco coming out of passage 6 separates the lighter tobacco particles, i.e. those with less kinetic energy, which are then detoured upwards inside channel 8 and underneath belt 9.

The heavier particles coming out of passage 6, on the other hand, continue moving in an essentially horizontal direction so as to penetrate inside whichever one of conveyor pockets 27 is at that time facing chamber 15.

Rotary conveyor element 22 is turned at such a relatively low speed as to reduce essentially to zero the kinetic energy thereto possessed by the said heavier particles which, once inside any of pockets 27, are moved forward by conveyor element 22 in such a manner as to be first isolated from any depression inside chamber 15 and then brought up to room pressure when the said pocket 27 comes into communication with hole 21. When the said pocket (27) is moved forward again, the tobacco particles inside it are brought over the top end of portion 28 on channel 16 into which the particles are dropped at an initial speed of essentially zero and at room pressure.

When, as they drop along portion 28 of channel 16, the particles encounter the upward-moving air stream blowing through hole 29, they are expanded violently as a result of which large part of the lighter particles clinging to and/or wrapped round the woody particles are separated from the latter and blown towards chamber 15 and, from there, into channel 8.

If, as in the arrangement shown, body 31 is provided, the lighter particles are helped back up by channel 33 the essentially vertical position of which minimises interference between the upward-moving tobacco particles and those moving through chamber 15 towards rotary conveyor element 22.

The tobacco particles of sufficient mass as to overcome the air stream from hole 29 continue to fall along bottom portion 32 of channel 16 and are taken up by the depression generated by the air stream blowing through hole 34. The resulting expansion separates any remaining lightweight particles which are sent back up along channel 11 or, if wall 36 is provided, along channel 37 the essentially vertical position of which helps the particles back up through chamber 15 to channel 8.

I claim:

1. A method for separating tobacco particles in cigarette manufacturing machines having a receiving chamber for a flow of shredded tobacco particles, a supply and a reject channel extending upwardly and downwardly respectively from said receiving chamber, said supply and reject channels being substantially aligned with each other, and a by-pass channel having an inlet which communicates with said receiving chamber, and an outlet which communicates with said reject channel; the method comprising the steps of:

reducing the air pressure in said supply and reject channels and in said receiving chamber so as to generate a main air current flowing upwardly along said reject and supply chamber and across said receiving chamber;

feeding said tobacco particles at relatively high speed into said receiving chamber and across said main air current towards the inlet of said by-pass channel;

bringing to a substantial halt those of said tobacco particles which enter said by-pass channel;

isolating from said reduced air pressure said substantially halted particles within a portion of said by-pass channel;

increasing the air pressure within said portion of said by-pass channel; and dropping said isolated particles at substantially zero initial speed into said reject channel from said portion of said by-pass channel and across at least one upwardly moving secondary air current flowing into said main current.

2. A method as claimed in claim 1, wherein said portion of said by-pass channel is defined by a rotary conveyor element housed in an airtight manner within said by-pass channel.

3. A method as claimed in claim 2, wherein said rotary conveyor element has a plurality of peripheral conveying pockets; said portion of said by-pass channel being defined by at least one said pocket; and said increase in pressure being performed by rotating said rotary conveyor element so as to separate in an air tight manner said pocket from said receiving chamber, and by then putting said pocket into communication with the outside atmosphere.

4. A method as claimed in claim 1, wherein said at least one upwardly moving secondary air current flows along a respective upward secondary channel an output of which communicates with a top portion of said reject channel.

5. A method as claimed in claim 4, wherein said secondary channel is adjustable in cross section.

6. A method for separating tobacco particles in a cigarette manufacturing machine having a receiving chamber for a flow of shredded tobacco particles; a supply and a reject channel extending upwardly and downwardly from said receiving chamber respectively, said supply and reject channels being substantially aligned with each other; a bypass channel having an inlet which communicates with said receiving chamber, and an outlet which communicates with said reject channel; and conveyor means arranged within said by-pass channel and comprising at least one particle-accommodating pocket-defining member movable along a portion of said by-pass channel from a first particle-receiving position, in which said pocket communicates with said receiving chamber, and through a second position in which said pocket is isolated in an airtight manner from said receiving chamber; the method comprising the steps of:

reducing the air pressure in said supply and reject channels and in said receiving chamber so as to generate a main air current flowing upwardly along said reject and supply channels and across said receiving chamber;

feeding said tobacco particles at relatively high speed into said receiving chamber and across said main air current towards the inlet of said by-pass channel and into said pocket-defining member in said first position;

operating said conveyor means so as to move at a relatively low speed said pocket-defining member from said first to said second position;

increasing the air pressure within said pocket when said pocket-defining members moves through said second position;

generating at least one secondary air current flowing upwardly into said main current and across a low portion of said reject channel;

dropping said particles at said relatively low speed from said pocket-defining member into said low portion of said reject channel and across said secondary air current.

7. A method as claimed in claim 6, wherein said by-pass channel comprises a cylindrical chamber having an axis which is arranged transversely of the direction of flow of said main current; said cylindrical chamber accommodating said conveyor means, and said conveyor means comprising a conveyor element mounted for rotation within said cylindrical chamber and about the axis thereof and comprising a plurality of blades extending outwardly and defining therebetween a plurality of conveying pockets; said blades slidably engaging in an airtight manner, a surface of said cylindrical chamber.

8. A method as claimed in claim 6, wherein said by-pass channel extends between a body separating said by-pass channel from said reject channel, and a wall separating said by-pass channel from the outside atmosphere; a hole being provided through said wall at said second position, and said increase in pressure being obtained by putting said pocket in communication with the outside atmosphere through said holes.

9. A method as claimed in claim 8, wherein at least a further hole is provided through said wall at said low portion of said by-pass channel; said further hole being an inlet for said secondary air current.

* * * * *